US008632072B2

(12) United States Patent
Loveland

(10) Patent No.: US 8,632,072 B2
(45) Date of Patent: Jan. 21, 2014

(54) PUZZLE WITH POLYCUBES OF DISTRIBUTED AND LOW COMPLEXITY FOR BUILDING CUBE AND OTHER SHAPES

(76) Inventor: Damien Gerard Loveland, Richmond (CA)

( * ) Notice: Subject to any disclaimer, the term of this patent is extended or adjusted under 35 U.S.C. 154(b) by 151 days.

(21) Appl. No.: 12/839,393

(22) Filed: Jul. 19, 2010

(65) Prior Publication Data

US 2012/0013072 A1 Jan. 19, 2012

(51) Int. Cl.
*A63F 9/12* (2006.01)

(52) U.S. Cl.
USPC ..... 273/157 R

(58) Field of Classification Search
USPC ..... 273/153 S, 157 R, 156
See application file for complete search history.

(56) References Cited

U.S. PATENT DOCUMENTS

| | | | | | |
|---|---|---|---|---|---|
| 1,702,505 | A | * | 2/1929 | Groves | 273/157 R |
| 3,065,970 | A | * | 11/1962 | Besley | 273/160 |
| 3,672,681 | A | * | 6/1972 | Wolf | 273/157 R |
| 3,771,795 | A | | 11/1973 | Flanigen | |
| 3,788,645 | A | | 1/1974 | Nelson | |
| 4,036,503 | A | * | 7/1977 | Golick | 273/153 S |
| 4,153,254 | A | * | 5/1979 | Marc | 273/160 |
| 4,210,333 | A | | 7/1980 | Shanin | |
| 4,662,638 | A | * | 5/1987 | Vachek | 273/160 |
| 4,699,602 | A | | 10/1987 | Giorgi | |
| 4,784,392 | A | * | 11/1988 | Johnson et al. | 273/160 |
| 5,393,063 | A | * | 2/1995 | Ichimaru | 273/160 |
| 5,649,703 | A | * | 7/1997 | Kanbar | 273/157 R |
| 5,823,533 | A | * | 10/1998 | Edwards | 273/160 |
| 6,648,330 | B2 | * | 11/2003 | Porter | 273/153 R |
| 6,910,691 | B2 | * | 6/2005 | Shih | 273/157 R |
| 7,140,612 | B2 | * | 11/2006 | Chen | 273/156 |
| 2002/0121739 | A1 | * | 9/2002 | Sum | 273/156 |

FOREIGN PATENT DOCUMENTS

| | | |
|---|---|---|
| DK | 52215 | 9/1936 |
| GB | 420349 | 11/1934 |

OTHER PUBLICATIONS

Kurowski, Scott. "Bedlam / Crazee Cube Solved : Tetris Cube Solved", retrieved from http://scottkurowski.com on Jun. 17, 2010.
Chruscinski, Dan. "How to Design a 3D Cube Puzzle", retrieved from http://www.ehow.com/how_5714522_design-3d-cube-puzzle.html on Jun. 17, 2010.
Fawcett, Ben. "Soma Cube Challenge", retrieved from http://www.hangingloose.net/Games/Soma_Cube_Challenge.html on Jul. 5, 2010.
Gooch, Jim. "ASCII Art Gallery Puzzles—Article 8312 in rec. puzzle", retrieved from http://www.heartnsoul.com/ascii_art/puzzles.txt on Jul. 5, 2010.
Köller, Jürgen. "Tetracube", retrieved from http://www.mathematische-basteleien.de/tetracube.htm on Jul. 5, 2010.

(Continued)

*Primary Examiner* — Steven Wong

(57) ABSTRACT

An assembly puzzle comprising different polycubes that can be arranged to form a cube comprising sixty-four unit cubes. Included in the puzzle are polycubes of a sufficiently distributed complexity to allow meaningful hints to be given without actually providing a solution. Furthermore, the polycubes can be arranged in different configurations to build a wide variety of shapes other than a cube.

5 Claims, 5 Drawing Sheets

(56) References Cited

OTHER PUBLICATIONS

Armitage, Fred. "Hollow Planar Pentacubes", retrieved from http://www.asahi-net.or.jp/~rh5k-isn/Puzzle/444/HollowPlanarPentacubes/ on Jul. 5, 2010.

Levonen, Juha. "Juha's Unique 13", retrieved from http://www.asahi-net.or.jp/~rh5k-isn/Puzzle/444/JuhasUnique/13/ on Jul. 5, 2010.

Levonen, Juha. "Juha's Unique Dozen", retrieved from http://www.asahi-net.or.jp/~rh5k-isn/Puzzle/444/JuhasUnique/12/ on Jul. 5, 2010.

Lakerveld, Ted. "Roundabout the Tetro's", retrieved from http://www.asahi-net.or.jp/~rh5k-isn/Puzzle/444/RoundaboutTheTetros/ on Jul. 5, 2010.

Ishino, Keiichiro. "Put-Together (polyomino : 4×4×4)", retrieved from http://www.asahi-net.or.jp/~rh5k-isn/Puzzle/-/polyomino-444.xml#polyomino-444 on Jul. 10, 2010.

Ishino, Keiichiro. "Puzzle will be played . . . ", retrieved from http://www.asahi-net.or.jp/~rh5k-isn/Puzzle/-/shape.xml on Jul. 10, 2010.

* cited by examiner

PUZZLE WITH POLYCUBES OF DISTRIBUTED AND LOW COMPLEXITY FOR BUILDING CUBE AND OTHER SHAPES

BACKGROUND

1. Field of the Invention

The present document relates to a cube puzzle comprising differently shaped polycubes that can be arranged and assembled to form a cube. The side of the cube is four units long and the polycubes each include one or more smaller cubes, each smaller cube having a side of length one unit. Furthermore, the polycubes can be arranged in different configurations to build a wide variety of shapes other than a cube.

2. Description of Related Art

Existing 4×4×4 cube puzzles such as the Bedlam Cube™, also known as the Crazee Cube™, and the Tetris Cube™, are known to be extremely difficult. While many solutions to each can be found, just finding one of them is considered to be very much a random process. As a result, there may be some users that quickly lose interest in such cubes. The Bedlam Cube™ comprises twelve polycubes each of five unit cubes and one polycube of four units. The Tetris Cube™ comprises eight polycubes each of five unit cubes and four polycubes each of six unit cubes. There are other 4×4×4 puzzles with very complex polycubes which are not appropriate for building a wide range of other meaningful shapes.

U.S. Pat. No. 3,065,970 discloses a puzzle comprising polycubes that can be assembled to form different rectangular parallelepipeds. U.S. Pat. No. 4,662,638 discloses a 4×4×4 cube puzzle comprising twelve polycubes each of five unit cubes and one polycube of four units. U.S. Pat. No. 5,823,533 discloses a puzzle for making a 4×4×4 cube comprising planar, or 2D, polycubes.

Existing commercially available puzzles generally comprise sets of polycubes with minimal range in their size or complexity. Solutions, rather than hints, to such puzzles can easily be found on the internet. In contrast, it would be beneficial to have a puzzle that lends itself to the provision of hints that can teach a user how to solve it, thereby preserving some of the user's sense of achievement.

SUMMARY

The invention described herein is directed to a cube puzzle comprising differently shaped polycubes that can be arranged and assembled to form a cube. The side of the cube is four units long and the polycubes each include one or more smaller cubes, each smaller cube having a side of one unit length. More specifically, it relates to the inclusion of polycubes of a sufficiently distributed complexity or difficulty in placing, which allows meaningful hints to be given without actually providing a solution. An assembly puzzle is presented herein comprising a plurality of polycubes wherein at least one polycube is unique; at least two polycubes are selected from the group consisting of monocubes, dicubes, tricubes and planar tetracubes; and at least one polycube is a pentacube. Furthermore, the polycubes can be arranged in different configurations to build a wide variety of shapes other than a cube.

DETAILED DESCRIPTION

A polycube is a three dimensional shape comprised of one or more similar cubes. A monocube comprises a single unit cube; a dicube comprises two unit cubes; a tricube comprises three unit cubes; a tetracube comprises four unit cubes; a pentacube comprises five unit cubes; a hexacube comprises six unit cubes; a heptacube comprises seven unit cubes; an octocube comprises eight unit cubes; and so on.

Each polycube has an envelope with dimensions corresponding to the polycube's maximum length, width and height. An envelope is a rectangular parallelepiped into which the polycube would fit, and may be described as the minimum envelope of the polycube. When not referring to a specific polycube, an envelope in general may accommodate polycubes with a minimum envelope equal in size to or smaller sized than the general envelope. An example of an envelope may be 3×2×2 units, which may also be referred to as a 3×2×2 unit envelope, a 3×2×2 envelope, an envelope measuring 3×2×2 cube units or 3×2×2 units cubed. The word unit may be used to refer to the length of a unit cube, the volume of a unit cube or a unit cube itself.

Figure 1:
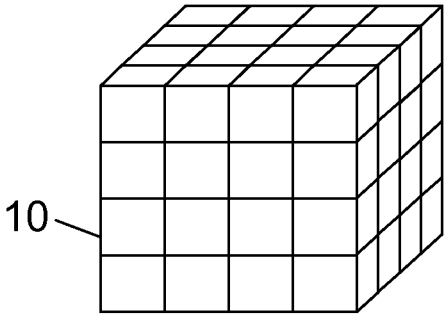
FIG. 1 is a view of the puzzle assembled to form a cube.

One of the aims of the puzzle is to build a cube with each side measuring four units long. The cube to be built therefore comprises 64 smaller cubes, each with a side one unit long. FIG. 1 shows a cube that can be built with the polycubes of the puzzle. The cube comprises sixty-four unit cubes 10. Each smaller cube may be referred to as a unit cube, or a unit. Each polycube in the puzzle may comprise one or more unit cubes. The units cubes in a polycube may be individual unit cubes that have been joined together, or they may simply define the volumetric extent of the polycube without being real cubes. For example, a polycube that contains three unit cubes in a line may actually be a single contiguous piece of material that is three units long and has a square cross section of one unit by one unit.

In order to create a cube puzzle that is solvable by more people but that still remains challenging, a sufficient range of polycubes of a different complexity are included. Loosely defined, the complexity of a polycube is approximately in line with the number of unit cubes within the polycube. For example, a tricube is less complex than a pentacube, and as a result, a tricube is generally easier to place than a pentacube. An example of a sufficient range of complexity would be to have some tricubes and some pentacubes. Another example would be to have some tricubes, some tetracubes and some pentacubes. Yet another example would be a puzzle with one or more dicubes or tricubes, one or more tetracubes and one or more hexacubes. A further way to choose a range for the polycubes would be to ensure that there at least some polycubes each with at least two units more than the polycubes with the least units. The selection of polycubes should be made carefully according to the guidelines given herein.

As well as including polycubes of different complexity, there should be a sufficient number of polycubes of each complexity in order to provide a choice to the user. For example, if there were only one polycube of a lesser complexity than the other polycubes, then there would be a smaller impact on making the puzzle easier than if there were two polycubes of lesser complexity. Furthermore, any hint that could be given that relies on distinguishing between polycubes of different complexity would define a specific polycube, whereas it may be desired to be able to provide a hint that does not identify a single specific polycube.

Another way of defining complexity is by determining the smallest rectangular parallelepiped envelope into which a polycube fits. Polycubes that occupy larger such envelopes can be considered as having greater complexity than polycubes that have smaller such envelopes. For example, a planar pentacube in the shape of a cross (FIG. 4*q*) has an envelope of 3×3×1 units cubed. Considering one orientation only of the cross pentacube, it can be placed in the 4×4×4 envelope of the final cube in 16 different positions, i.e. in four different locations in each of the four layers of the final cube. A polycube such as that in FIG. 4*m*, for example, occupies a 3×2×2 envelope, and in a given orientation can be placed in the 4×4×4 envelope of the final cube in 18 different positions, and is therefore slightly easier to place than the cross pentacube. As more and more polycubes are placed by the user, differences in the ease with which the remaining polycubes can be placed become more pronounced. In order to retain the challenge of the puzzle, there may be some, but not too many, polycubes of greater complexity, such as pentacubes with 3×3×1 envelopes. Additionally, if the number of polycubes of greater complexity is not too high, then there are more possibilities for building shapes other than a 4×4×4 cube.

Figure 2:
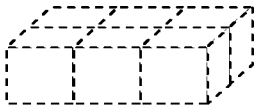
FIG. 2 is a 3 unit×2 unit×1 unit envelope into which certain polycubes of the puzzle can fit.
Figure 3A:
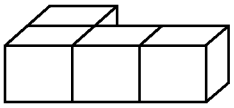
FIGS. 3*a-h* show polycubes of 1, 2, 3 and 4 unit cubes which can fit into a 3×2×1 envelope.
Figure 3B:
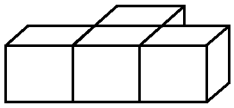
Figure 3C:
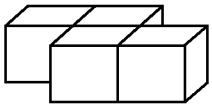
Figure 3D:
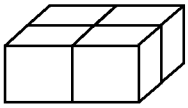
Figure 3E:
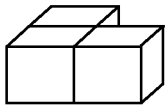
Figure 3F:
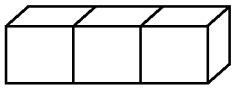
Figure 3G:
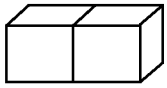
Figure 3H:
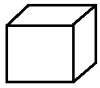

In general, polycubes with five, six or more unit cubes can be considered to be complex polycubes. Lower complexity polycubes can be defined to be planar, with one, two, three or four unit cubes. FIG. 2 shows a planar envelope measuring 3×2×1 units. As well as having four or fewer unit cubes, at least two polycubes of the puzzle should fit into a 3×2×1 envelope in order to ensure that there are enough polycubes of a lower complexity. FIGS. 3*a*-3*h* each show a different polycube that may be used in the puzzle, each polycube being able to fit into the 3×2×1 envelope of FIG. 2. This group of polycubes comprises planar tetracubes, tricubes, dicubes and monocubes. It is not necessary to use only two of these polycubes, as three, four or more can be used. Puzzles without monocubes and dicubes are usually more challenging, depending on the choice of the other polycubes. It is also possible to use two or more identical polycubes in the puzzle.

Figure 4A:
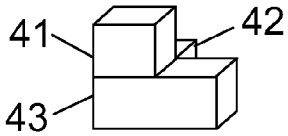
FIGS. 4*a-k*, 4*m-n*, and 4*p-q* together show an example set of polycubes that can be arranged to form a 4 unit×4 unit×4 unit cube.
Figure 4B:
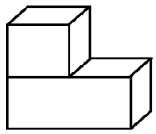

The following is an example of an embodiment of the puzzle. The polycubes in this embodiment are shown in FIGS. 4*a*-4*k*, 4*m*, 4*n*, 4*p* and 4*q*. The polycubes are shown as if they were made from one unit long, two unit long and three unit long parts that may, for example, be cut from a one unit square section length of wood. For example, the polycube of FIG. 4*a* is made of a two unit length 43 with two unit cubes 41, 42 glued to it. The polycube of FIG. 4*g* comprises a three unit length component 45.

Figure 4C:
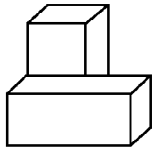
Figure 4D:
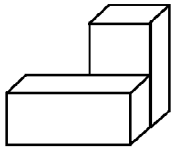
Figure 4E:
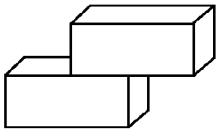
Figure 4F:
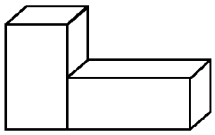
Figure 4G:
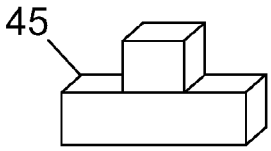
Figure 4H:
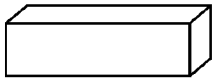
Figure 4I:
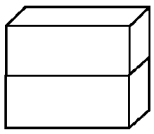
Figure 4J:
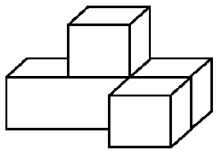
Figure 4K:
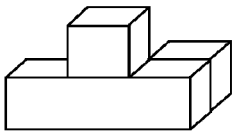
Figure 4M:
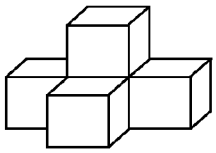
Figure 4N:
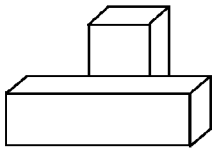

The embodiment comprises low, medium and high complexity polycubes. Low complexity polycubes are defined as those with four or fewer unit cubes that can fit within the general 3×2×1 envelope of FIG. 2. It can be see that in the set of polycubes in this embodiment, there are six such low complexity polycubes. These six polycubes are shown in FIG. 4*b* and FIGS. 4*e*-4*i*. The tetracubes of FIGS. 4*e*-4*g* and 4*i* are planar tetracubes because their unit cubes all lie in the same plane. Also, in this embodiment's set of polycubes, it can be seen that there are three polycubes of medium complexity, as shown in FIG. 4*a*, FIG. 4*c* and FIG. 4*d*, where medium complexity is defined as those polycubes with a 2×2×2 envelope. The embodiment also comprises six polycubes of higher complexity, each of them having five unit cubes, as shown in FIGS. 4*j*, 4*k*, 4*m*, 4*n*, 4*p* and 4*q*. Depending on how they are rotated, the polycubes in FIGS. 4*j*, 4*k*, 4*m* and 4*n* are unique pentacubes each comprising a T shaped tetracube in a first plane and an additional cube in a second plane on top of or parallel to the first plane, resulting in polycubes with 3×2×2 envelopes. This example of a puzzle therefore comprises polycubes with a range of different complexities, or placement difficulties.

Figure 4P:
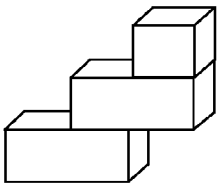
Figure 4Q:
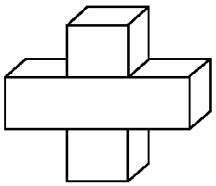

Among these latter six polycubes described with high complexity, there are two planar tetracubes that can be considered as having slightly higher complexity than the other, non-planar tetracubes, these being the W pentacube in FIG. 4*p* and the cross pentacube of FIG. 4*q*, both having a 3×3×1 envelope. One way to limit the overall difficulty of the puzzle and not place too much restraint on the choice of other shapes that may be built would be to limit the number of polycubes having a 3×3×1 envelope. While there are two such polycubes in the embodiment shown, the limit may also be one or three, for example, or more.

Table 1 shows, for each of a variety of minimum rectangular parallelepiped envelopes, the number of polycubes that have such envelopes in the embodiment of the puzzle. For each minimum envelope, the number of distinct positions in a 4×4×4 envelope is shown. The number of positions corresponds to the number of different positions into which the polycube can theoretically be placed within the final 4×4×4 envelope of the cube, without rotating the polycube, and without any other polycubes present. In general, the lower the number of positions, the greater the complexity of the polycube, but this is not exact because planar tetracubes with a 3×2×1 envelope are easier to place than three dimensional tetracubes with 2×2×2 envelopes, as they require less demand on a person's spatial awareness capability. The level of difficulty is shown in the third column. The minimum envelopes are broadly categorized into high, medium and low complexity. A puzzle with distributed complexity polycubes would have at least one polycube in each of these three categories. A puzzle with a better distributed complexity of polycubes would have at least two polycubes in each of these three categories. A puzzle with a still better distributed complexity of polycubes would have at least three polycubes in each of these three categories.

Very high complexity polycubes may be defined as those with even more restricted positioning options, and/or those having larger envelopes, such as 4×2×2, 3×3×3, 4×3×2, 4×3×3, 4×4×2, 4×4×3 and 4×4×4. One or more of these very high complexity polycubes may be included in the puzzle but this will tend to reduce the number of other shapes that can be built.

Note that the scale of complexity described above is an approximate scale and it may be defined in other ways. For example, complexity may be defined more directly as the number of unit cubes in a polycube, where the higher the number of unit cubes, the higher the complexity. As can be seen in the table, the number of units in the polycubes generally increases with complexity as defined, but these numbers are not exactly in the same order as the scale based on the minimum envelope sizes. Note that for a given minimum envelope of A×B×C, a polycube may have from A+B+C−2 units to ABC units, and polycubes are usually selected from the lower end of this range. An example of a puzzle with polycubes of spread complexity using this definition would have at least two polycubes with three units, two polycubes with four units and at least two polycubes with five units.

TABLE 1

| | | | Example of present cube | | Bedlam Cube ™ | | Tetris Cube ™ | |
|---|---|---|---|---|---|---|---|---|
| Minimum envelope | Number of positions | Difficulty | Number of polycubes | Unit cubes in each polycube | Number of polycubes | Unit cubes in each polycube | Number of polycubes | Unit cubes in each polycube |
| 3 × 3 × 2 | 12 | High | | | | | 4 | 6 |
| 4 × 2 × 1 | 12 | | | | | | 2 | 5 |
| 4 × 1 × 1 | 16 | | | | | | | |
| 3 × 3 × 1 | 16 | | 2 | 5 | 3 | 5 | 1 | 5 |
| 3 × 2 × 2 | 18 | | 4 | 5 | 9 | 5 | 4 | 5 |
| 2 × 2 × 2 | 27 | Medium | 3 | 4 | 1 | 4 | 1 | 5 |
| 3 × 2 × 1 | 24 | Low | 3 | 4 | | | | |
| 3 × 1 × 1 | 32 | | 1 | 3 | | | | |
| 2 × 2 × 1 | 36 | | 2 | 3, 4 | | | | |
| 2 × 1 × 1 | 48 | | | | | | | |
| 1 × 1 × 1 | 64 | | | | | | | |

The last five rows may be considered to represent minimum envelopes of low complexity polycubes. These envelopes are 3×2×1, 3×1×1, 2×2×1, 2×1×1 and 1×1×1, and they are all planar. Note that the current embodiment has six such low complexity polycubes in its set. In comparison, the Bedlam Cube™ and the Tetris Cube™ have no polycubes at this level of complexity.

The embodiment of the puzzle has at least six polycubes each having one of six different envelope sizes. Alternate embodiments may have at least five polycubes each having one of five of these six different envelope sizes.

Figure 5:
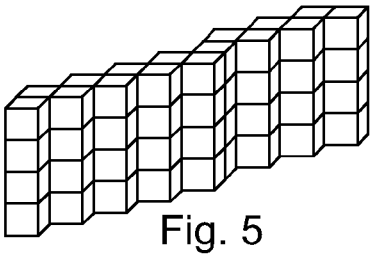
FIGS. 5-21 show shapes that can be made by assembling the example set of polycubes shown in FIGS. 4*a-k*, 4*m-n*, and 4*p-q*.
Figure 6:
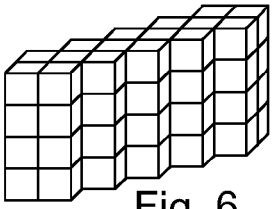
Figure 7:
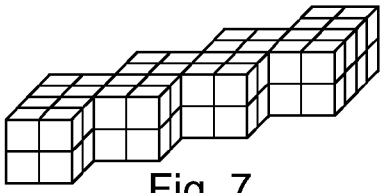
Figure 8:
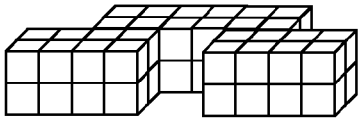
Figure 9:
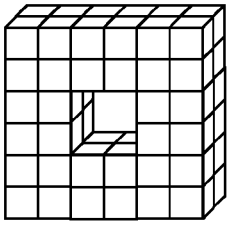
Figure 10:
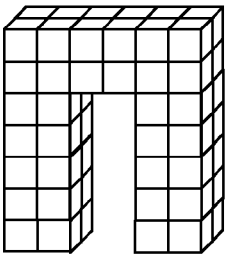
Figure 11:
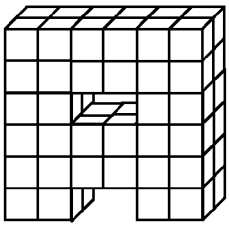
Figure 12:
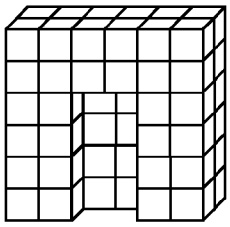
Figure 13:
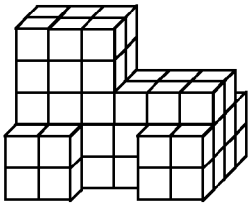
Figure 14:
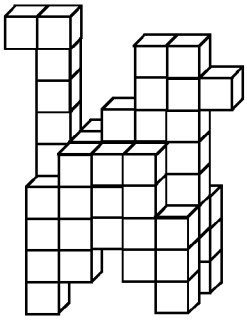
Figure 15:
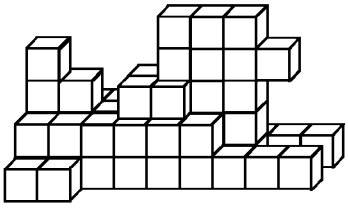
Figure 16:
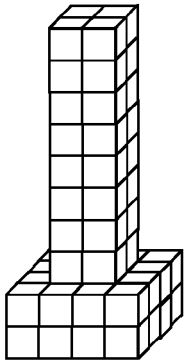
Figure 17:
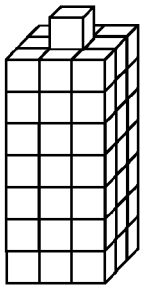
Figure 18:
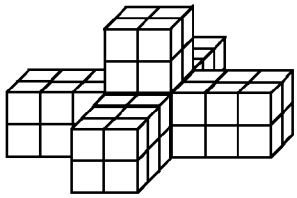
Figure 19:
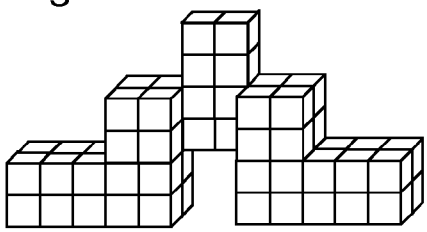
Figure 20:
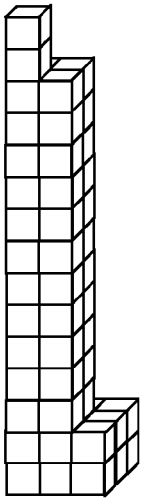
Figure 21:
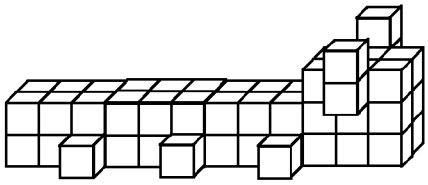
Figure 22:
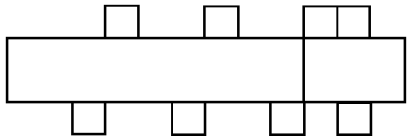
FIG. 22 is a top view of the shape in FIG. 21
Figure 23A:
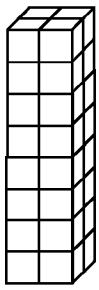
FIGS. 23*a-b* show two shapes that can be made simultaneously by assembling the example set of polycubes shown in FIGS. 4*a-k*, 4*m-n*, and 4*p-q*.
Figure 23B:
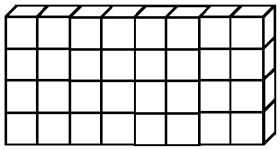
Figure 24A:
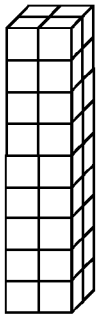
FIGS. 24*a-b* show two other shapes that can be made simultaneously by assembling the example set of polycubes shown in FIGS. 4*a-k*, 4*m-n*, and 4*p-q*.
Figure 24B:
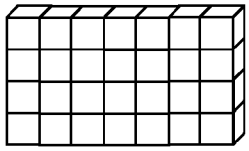

FIGS. 5-21 show other shapes that can be made by assembling the example set of polycubes that are shown in FIGS. 4*a-k*, 4*m-n*, and 4*p-q*. FIGS. 5-7 show zig-zag walls. FIG. 8 shows a wall with a recess. FIG. 9 shows an "O". FIG. 10 shows an upside down "U". FIG. 11 shows an "A". FIG. 12 shows an alcove. FIG. 13 shows a tractor. FIGS. 14-15 show dogs. FIGS. 16-17 show towers. FIG. 18 shows a cross with a pedestal. FIG. 19 shows a lifted gate. FIG. 20 shows a tower. FIG. 21 shows a caterpillar and FIG. 22 shows a top view of it. FIGS. 23*a-b* show a wall and a tower that can be made at the same time with the set of polycubes. FIGS. 24*a-b* also show a wall and a tower that can be made at the same time with the set of polycubes.

An advantage of the particular set of polycubes shown in FIGS. 4*a-q* is that it comprises the polycubes of the Soma cube. It is not necessary that the puzzle comprise the Soma cube polycubes, but if it does, then they can be used separately as a starter puzzle before the main puzzle is tackled, or as an additional puzzle to solve. The polycubes of the Soma cube are shown in FIGS. 4*a-g*. and they may be assembled to form a cube with a side of three units. In another embodiment, a 4×4×4 puzzle that comprises the polycubes of a Soma cube may not have any restrictions on the number, shapes and/or sizes of the other polycubes.

This paragraph contains hints to solving the cube. If a user takes the puzzle at face value and tries to solve it by trial and error, the solution may be arrived at randomly. However, the user may realize that there are significant differences between the polycubes and discover a method of solving the puzzle by making use of these differences. If not, the user may be told that there are significant differences that have a bearing on how to solve the puzzle. If the user positions the more complex polycubes first and the least complex polycubes last, then the user retains more freedom for placing the final polycubes. As a result, the user retains the possibility of rearranging them in more combinations in order to try and complete the puzzle. If the more complex polycubes were left until last, they would be much less likely to fit into the remaining spaces in the 4×4×4 envelope of the final cube. By making the right choice of which polycubes to use first, a user can greatly simplify the solving of the puzzle. A second hint that may be given is the fact that it is generally easier to leave the less complex polycubes that are also planar until the end, aiming throughout the puzzle to build up the cube in layers. For example, the low complexity planar polycubes would all fit within a 3×2×1 unit envelope, which may be a minimum envelope for some of the polycubes but not for all. For example, the polycubes of FIGS. 4*b* and 4*h* would fit into the 3×2×1 envelope, but it wouldn't be their minimum envelope.

This paragraph contains one of the many solutions. For an exact solution, one can place the polycubes in the following order onto a flat surface, mindful not to exceed a 4×4×4 envelope. The polycubes are given their numbering as in FIGS. 4*a-q*. Start with polycube 4*c* in the orientation as shown in FIG. 4*c*, then without lifting it, rotate it 90° counterclockwise; place polycube 4*b* flat on the surface behind the first polycube to form a rectangular base layer 2 units wide and three units deep; polycube 4*d* to the left, flush with the front of the other polycubes and with one unit cube behind the polycube projecting up; polycube 4*h* arranged left to right at the back making the base layer a rectangular envelope 3 units wide by 4 units deep; polycube 4*g* flat on the surface and filling the hole on the left to form part of the left side of the 4×4 base layer; polycube 4*e* upright in the front left corner and on the left hand edge; polycube 4*m* flat on the right hand edge covering the rear three squares of the right edge; polycube 4*i* upright in the middle of the back row; polycube 4*a* in the left hand hole in the front row, pointing back and to the right; polycube 4*f* in an 'L' orientation in the far left corner with the short end pointing towards you; polycube 4*p* on the three steps at the front of the right hand edge; polycube 4*q* in the deepest hole; polycube 4*j* tilted forwards 90° and placed into the far right corner; polycube 4*n* upside down in the right hole; and then polycube 4*k* in the remaining position.

Other embodiments of the puzzle are possible that use different sets of polycubes, providing that the polycubes fall into the categories defined herein. Polycubes may be used which fall into the categories described, even though they are not specifically shown. An example of such a polycube would be a planar U-shaped pentacube. If one or more of the polycubes are different to those in the example described above and shown in FIGS. 4*a-q*, it may not be possible to build all of the shapes specifically shown in FIGS. 5-24*b*, even though it will still be possible to build a cube.

The set of polycubes in the puzzle may all be unique or may comprise two or more identical shapes. However, at least one polycube should be unique to avoid the case where the puzzle actually consists of two identical puzzles of half the size, such as two identical puzzles that each form a 4×4×2 rectangular parallelepiped.

It is advisable to have fourteen, fifteen or sixteen polycubes in the puzzle in order to ensure that there are enough polycubes of low complexity and not too many of a high complexity. However, this is not a strict requirement, and other quantities of polycubes are possible such as thirteen, seventeen or more.

One or more polycubes of very high complexity may be included, but to compensate for this, a greater number of low complexity polycubes should be included so that the puzzle does not become too difficult. It should be borne in mind that as more complex polycubes are included, the number of other meaningful shapes that can be built with the puzzle diminishes. For example, the puzzle may comprise a heptacube with envelope 3×3×3, a hexacube with envelope 3×3×2, seven pentacubes, two tetracubes, two tricubes and one dicube, making a total of fourteen polycubes in the puzzle. A simpler puzzle may comprise a heptacube, a hexacube, three pentacubes, seven tetracubes, two tricubes and one dicube, making a total of fifteen polycubes in the puzzle.

Table 2 shows examples of groups of polycubes that may be used for the puzzle. The list is not exhaustive, but serves to give some other embodiments that are possible. All have at least two polycubes fitting in a general 3×2×1 envelope, i.e. monocubes, dicubes, tricubes and planar tetracubes. All but two have two pentacubes, and these two have at least one heptacube or hexacube. The fewer the total number of polycubes in the puzzle, the harder it is to complete.

TABLE 2

| Number of each type of polycube | | | | | | | | |
|---|---|---|---|---|---|---|---|---|
| Hepta | Hexa | Penta | Tetra (any) | Tetra (planar) | Tri | Di | Mono | Number of polycubes |
| | | 6 | 7 | | 2 | | | 15 |
| | | 5 | 8 | 1 | 1 | | | 15 |
| | | 7 | 5 | | 3 | | | 15 |
| | | 8 | 3 | | 4 | | | 15 |
| | | 7 | 6 | | 1 | 1 | | 15 |
| | 1 | 5 | 7 | | 1 | 1 | | 15 |
| | 2 | 3 | 8 | | 1 | 1 | | 15 |
| | 2 | 4 | 6 | | 2 | 1 | | 15 |
| | 2 | 6 | 3 | | 2 | 2 | | 15 |
| | | 10 | 2 | | 1 | 1 | 1 | 15 |
| | 1 | 8 | 3 | | 1 | 1 | 1 | 15 |
| | 2 | 6 | 4 | | 1 | 1 | 1 | 15 |
| | 2 | 7 | 2 | | 2 | 1 | 1 | 15 |
| | 3 | 5 | 3 | | 2 | 1 | 1 | 15 |
| | 4 | 3 | 4 | | 2 | 1 | 1 | 15 |
| | | 2 | 12 | | 2 | | | 16 |
| | | 3 | 10 | | 3 | | | 16 |
| | | 4 | 8 | | 4 | | | 16 |
| | | 9 | 3 | 1 | 1 | | | 14 |
| | | 10 | 2 | | 2 | | | 14 |
| | 3 | 7 | 1 | 1 | 1 | | | 13 |
| | 4 | 5 | 2 | 1 | 1 | | | 13 |
| 2 | 4 | 1 | 3 | | 3 | | | 13 |

TABLE 2-continued

| Number of each type of polycube | | | | | | | | |
|---|---|---|---|---|---|---|---|---|
| Hepta | Hexa | Penta | Tetra (any) | Tetra (planar) | Tri | Di | Mono | Number of polycubes |
| | | 2 | 9 | | 6 | | | 17 |
| 1 | 1 | 1 | 8 | | 3 | 2 | 1 | 17 |

The polycubes of the puzzle may be made from wood, plastic, metal or some other material. They may be solid or hollow. For example, plastic injection molding may be used to make lightweight hollow polycubes, each formed by clipping or adhering two or more parts together. Unit-sized wooden cubes may be purchased from a craft store or otherwise provided to a user and glued together to form the polycubes. A square section length of wood may be cut into lengths of 1, 2 and 3 units, and these may be glued together to form the polycubes. Such pre-cut lengths may also be purchased from craft stores or dollar stores. The size of the unit square can be anything that is desired by the user. Non-limiting examples of unit dimensions that are convenient to use are 1 inch, 2 inch and 40 mm. The embodiment shown in FIGS. 4*a-q* requires seven 3-unit lengths, fifteen 2-unit lengths and thirteen unit cubes. The embodiment shown in FIGS. 4*a-q* may alternately be made from eight 3-unit lengths, thirteen 2-unit lengths and fourteen unit cubes, for example if the polycube in FIG. 4*f* is instead made from a three unit length and a unit cube.

Figure 25:
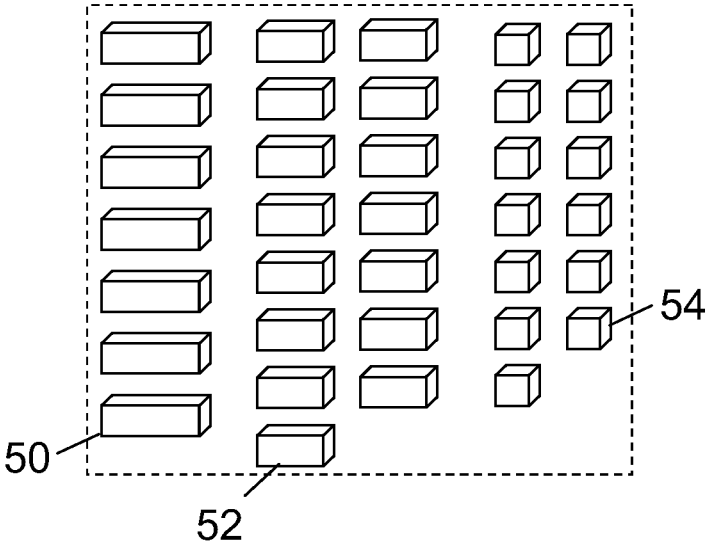
FIG. 25 shows a kit of parts that may be attached together to form the polycubes of a puzzle.

A kit of parts may be supplied for a user to make the puzzle polycubes. The kit could comprise enough pre-cut polycubes of wood of 1, 2 and 3 unit lengths to make the puzzle polycubes. In addition, the kit may optionally comprise some adhesive. For example, for the embodiment shown in FIGS. 4*a-q*, a kit may comprise 13 one-unit long polycubes, 15 two-unit long polycubes and 7 three-unit long polycubes. Such a kit is shown in FIG. 25. This kit comprises seven three-unit long polycubes 50, fifteen two-unit long polycubes 52 and thirteen one-unit long polycubes 54. The precise number of each length of wood polycube may be different, so long as there are at least enough wood polycubes to make a complete set of puzzle polycubes. If a different set of puzzle polycubes is chosen, then the optimum number of each length of wood polycube may be different. The preferred kit comprises as few separate polycubes as possible in order to minimize the number of glue joints to be made, although this is not strictly necessary. The wooden parts may be marked to show where the glue joints are to be made. Alternately, instructions may be provided that show where the glue joints are to be made. Plastic parts may alternately be provided in the kit, which may be fastened together.

Figure 26:
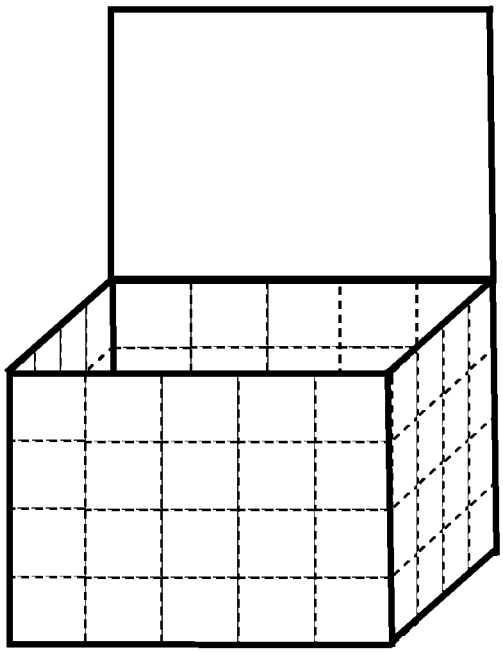
FIG. 26 shows a box that can accommodate an almost completed puzzle.

The kit of parts or the ready-made puzzle polycubes may be supplied with or in a box. The dimensions of the box may be such as to contain the assembled puzzle within. Preferably, one or more of the dimensions of the box is increased by one unit compared to the dimensions of the finished puzzle, such that the box may contain an incorrectly assembled puzzle. It is a lot easier for a user to almost complete the puzzle, for example, by leaving one unit cube out of place, than it is to perfectly complete the puzzle, with all unit cubes positioned within the 4×4×4 cubic envelope. Getting the polycubes back in the box, and closing the lid if present may therefore be a preliminary challenge for the user to complete. This will also make the puzzle more easily portable than if the polycubes had to be assembled into a solution and fitted snugly into a just big enough box. For example, the interior dimensions of a box in units may be 4×4×5. FIG. 26 shows a box with inner dimensions of 4×4×5 units, but not to scale with FIG. 25. The box may have a lid, and if so, the lid may be hinged or detachable. For embodiments where the puzzle can also be assembled as a 4×8×2 rectangular parallelepiped, which is the case for the embodiment of FIGS. 4*a-q*, interior box dimensions may be 4×9×2, 4×8×3, or 5×8×2. One of these flatter boxes may be more convenient for packing or shipping the puzzle. By making the inner dimensions of the box larger than that of a completed puzzle allows the box to be used to accommodate the polycubes when a user has not yet succeeded in assembling the puzzle. The puzzle may therefore be kept tidier when not in use.

The polycubes may be represented virtually, for example on a computer screen, or the screen of a smart phone or other computing device. The screen may be a touch or multi-touch screen, allowing for the polycubes to be manipulated easily by the user. A set of computer readable instructions in a computer readable medium in the device may be processed by a processor connected to the medium to display the polycubes and move the displayed polycubes in response to user inputs. The device may be configured to rotate the polycubes about 1, 2, or 3 orthogonal axes and snap the displayed polycubes into position or to each other, and detect when polycubes that have been virtually placed together form a cube, or other desired shape. Other human interfaces may be used for receiving inputs from the user, such as a mouse or a gesture detector.

The description includes references to the accompanying drawings, which form part of the description. The drawings, which may not be to scale, show, by way of illustration, a specific embodiment of the puzzle. Other embodiments, which are also referred to herein as "examples", "variations" or "options," are described in enough detail to enable those skilled in the art to practice the present invention. The embodiments may be combined, other embodiments may be utilized or structural or changes may be made without departing from the scope of the invention. Other embodiments or variations of embodiments described herein may also be used to provide the same functions as described herein, without departing from the scope of the invention.

In this document, the terms "a" or "an" are used to include one or more than one, and the term "or" is used to refer to a nonexclusive "or" unless otherwise indicated. In addition, it is to be understood that the phraseology or terminology employed herein, and not otherwise defined, is for the purpose of description only and not of limitation.

The invention claimed is:

1. An assembly puzzle consisting of a set of polycubes each comprising three or more unit cubes with sides of length one unit wherein:

the set of polycubes has a combined volume of sixty-four unit cubes;

the set of polycubes can be assembled to form a cube of side four units;

the set of polycubes can be assembled in multiple different predetermined three-dimensional configurations other than a cube, each presenting a further puzzle;

two polycubes are unique tricubes;

three polycubes are unique tetracubes each having a cubic envelope with sides of length two units;

four polycubes are unique planar tetracubes;

one polycube is a W shaped pentacube;

one polycube is a cross shaped pentacube; and four polycubes are unique pentacubes each comprising a T shaped tetracube in a first plane and a unit cube in a second plane above the first plane.

2. An assembly puzzle consisting of:

a set of polycubes each comprising three or more unit cubes with sides of length one unit wherein:

the set of polycubes has a combined volume of sixty-four unit cubes;

the set of polycubes can be assembled to form a cube of side four units;

the set of polycubes can be assembled in multiple different predetermined three-dimensional configurations other than a cube, each presenting a further puzzle;

two polycubes are unique tricubes;

three polycubes are unique tetracubes each having a cubic envelope with sides of length two units;

four polycubes are unique planar tetracubes;

one polycube is a W shaped pentacube;

one polycube is a cross shaped pentacube; and four polycubes are unique pentacubes each comprising a T shaped tetracube in a first plane and a unit cube in a second plane above the first plane;

and a box with interior unit dimensions of substantially 4×4×5, 4×2×9, 4×3×8 or 5×2×8.

3. The assembly puzzle according to claim 1 wherein one of said predetermined three dimensional configurations is a zig-zag wall of height four units having, in order, four sections two units long, one section three units long, two sections two units long and one section one unit long.

4. The assembly puzzle according to claim 1 wherein one of said predetermined three dimensional configurations is a tower of unit dimensions 2×2×8 and a wall of unit dimensions 8×4×1.

5. The assembly puzzle according to claim 1 wherein one of said predetermined three dimensional configurations is a tower of unit dimensions 2×2×9 and a wall of unit dimensions 7×4×1.

* * * * *